US006338747B1

(12) United States Patent
Kosco

(10) Patent No.: US 6,338,747 B1
(45) Date of Patent: Jan. 15, 2002

(54) METHOD FOR PRODUCING POWDER METAL MATERIALS

(75) Inventor: John C. Kosco, St. Marys, PA (US)

(73) Assignee: Keystone Investment Corporation, Wilmington, DE (US)

( * ) Notice: Subject to any disclaimer, the term of this patent is extended or adjusted under 35 U.S.C. 154(b) by 0 days.

(21) Appl. No.: 09/634,795

(22) Filed: Aug. 9, 2000

(51) Int. Cl.[7] ..... C22C 29/00

(52) U.S. Cl. ..... 75/243; 75/246; 419/11; 419/28; 419/29; 419/39; 419/55

(58) Field of Search ..... 75/246, 243; 419/11, 419/28, 29, 39, 55

(56) References Cited

U.S. PATENT DOCUMENTS

| | | | | | |
|---|---|---|---|---|---|
| 3,838,981 | A | | 10/1974 | Foley et al. | |
| 4,050,932 | A | * | 9/1977 | Lemmer | |
| 4,069,044 | A | * | 1/1978 | Mocarski et al. | 75/243 |
| 4,485,770 | A | | 12/1984 | Saka et al. | |
| 5,049,183 | A | | 9/1991 | Saka et al. | |
| 5,080,712 | A | | 1/1992 | James et al. | 75/229 |
| 5,221,321 | A | | 6/1993 | Lim | 75/246 |
| 5,290,508 | A | | 3/1994 | Kobayashi et al. | 419/54 |
| 5,453,242 | A | | 9/1995 | Knoess | 419/27 |
| 5,476,632 | A | | 12/1995 | Shivanath et al. | 419/57 |
| 5,512,236 | A | | 4/1996 | Jones et al. | 419/28 |
| 5,516,483 | A | | 5/1996 | Shivanath et al. | 419/14 |
| 5,540,883 | A | | 7/1996 | Jones et al. | 419/28 |
| 5,613,180 | A | | 3/1997 | Kosco | 419/5 |
| 5,656,787 | A | | 8/1997 | Shivanath et al. | 75/228 |
| 5,682,588 | A | * | 10/1997 | Tsutsui et al. | 419/11 |
| 5,754,937 | A | | 5/1998 | Jones et al. | 419/38 |
| 5,815,789 | A | | 9/1998 | Akpan | 419/2 |
| 5,834,640 | A | | 11/1998 | Shivanath et al. | 75/243 |
| 5,876,481 | A | | 3/1999 | Chagnon et al. | 75/255 |
| 5,997,805 | A | | 12/1999 | Lawcock et al. | 419/28 |
| 6,019,937 | A | * | 2/2000 | Shivanath et al. | 419/14 |

* cited by examiner

*Primary Examiner*—Ngoclan Mai
(74) *Attorney, Agent, or Firm*—Kirkpatrick & Lockhart LLP

(57) ABSTRACT

A method for producing a material includes providing a metallurgical powder including iron, 1.0 to 3.5 weight percent copper, and 0.3 to 0.8 weight percent carbon. At least a portion of the powder is compressed at 20 tsi to 70 tsi to provide a compact, and subsequently the compact is heated at high temperature and then cooled at a cooling rate no greater than 60° F. per minute to increase the surface hardness of the compact to no greater than RC 25. The density of at least a region of the sintered compact is increased, by a mechanical working step or otherwise, to at least 7.6 grams/cc. The sintered compact is then re-heated to high temperature and cooled at a cooling rate of at least 120° F./min. so as to increase the surface hardness of the compact to greater than RC 25, and preferably at least RC 30. Material made by the method of the invention also is disclosed.

57 Claims, 1 Drawing Sheet

METHOD FOR PRODUCING POWDER METAL MATERIALS

CROSS REFERENCE TO RELATED APPLICATIONS

Not applicable.

STATEMENT REGARDING FEDERALLY SPONSORED RESEARCH OR DEVELOPMENT

Not applicable.

TECHNICAL FIELD AND INDUSTRIAL APPLICABILITY OF THE INVENTION

The present invention is directed to a method for producing a material from a metallurgical powder and to the material produced by the method. More particularly, the present invention is directed to a method for producing a material from a metallurgical powder including iron, copper, and graphite, and wherein the method generally includes providing a sintered compact of the powder, densifying at least a portion of the compact, and subsequently increasing the surface hardness of the compact to greater than RC 25, and preferably at least RC 30. Material produced by the method exhibits high rolling contact endurance limit and/or high tensile strength. Specific examples of applications in which the method and material may be applied include races, gears, sprockets, and cam lobes.

DESCRIPTION OF THE INVENTION BACKGROUND

The "sinterhardening" process is a known process in which iron-based alloys having high hardness are produced by consolidating and sintering metallurgical powders. The alloying element and carbon contents of the metallurgical powder and the cooling rate of the sintered parts within the sintering furnace are carefully balanced to produce parts having a surface hardness greater than about Rockwell C (RC) 25 directly from the sintering furnace, without the requirement for a conventional quench-and-temper treatment. Parts having surface hardness greater than RC 25 are typically produced by sinterhardening using a furnace that is specially designed to gas cool the hot sintered parts at an accelerated rate, in the 120–200° F./minute range. More recently, sinterhardening processes have been designed to utilize metallurgical powders with higher alloy contents that can be hardened to greater than RC 25 on cooling using conventional sintering furnaces providing standard cooling rates, typically about 40° F./minute.

Sinterhardened parts are normally hard and strong (tensile strengths in the 120 to 160 ksi range). A primary advantage of the sinterhardening process is that the conventional quench-and-temper cycle is unneeded, reducing the number of processing steps and reducing the cost of finished parts. A second advantage is that gas cooling is less severe and causes less warpage than liquid cooling. Because sinterhardened parts are gas cooled rather than liquid cooled, there is generally less dimensional distortion in the parts and size control is enhanced. In addition, because there is no need to dispose of an oil or other liquid quenching medium, the impact on the environment is lessened.

A distinct shortcoming of parts produced by sinterhardening is relatively low rolling contact endurance limits, usually in the 160 to 190 ksi range. The rolling contact endurance limit, also referred to herein plainly as the "endurance limit," is the theoretical maximum stress that a material can withstand for an infinitely large number of compressive fatigue cycles. The endurance limit of a material may be assessed by, for example, the method described in U.S. Pat. No. 5,613,180, the entire disclosure of which is hereby incorporated herein by reference. The testing method generally described in the '180 patent was used to measure the endurance limit of the materials described herein.

Rolling contact endurance is particularly important in powder metal parts such as races, gears, sprockets, and cam lobes. The relatively low rolling contact endurance limit of sinterhardened materials is not entirely unexpected because the endurance limit is strongly dependent on material density. Denser materials typically have higher endurance limits. Parts produced by sinterhardening commonly have apparent densities of about 7.0 g/cc or less, which may be compared with typical theoretical densities of about 7.9 g/cc for sinterhardening alloys.

Materials produced by sinterhardening may have tensile strength significantly greater than powder metal materials of comparable density produced by conventional quench-and-temper techniques. Tensile strength of sinterhardened parts typically falls in the range of 130 to 150 ksi. This may be compared with the 100–110 ksi tensile strength of conventional quenched and tempered powder metal material at 7.0 g/cc. Conventional materials, because they are based on "softer" powders and do not harden on sintering at 1400–1600° F., can be double processed to densities in the 7.3–7.5 g/cc range. Increasing part density can provide increased tensile strength, and also can increase endurance limit. Heat treated double pressed/double sintered parts, for example, can achieve heat treated tensile strengths of 160–200 ksi. The higher tensile strength that may result from increased density may be desirable in parts used as races, gears, sprockets, cam lobes, connecting rods, and in other high load-bearing applications. Such applications usually also require high endurance limit. In contrast, increasing the density of sinterhardened parts to provide higher endurance limits and tensile strength is problematic. The metallurgical powder grades used in sinterhardening are highly alloyed and, therefore, are not highly compressible. Also, because sinterhardened parts emerge from the sintering furnace relatively hard, they are not easily densified by mechanical working techniques such as sizing. Cost and other benefits derived by avoiding a quench-and-temper cycle are, in part, offset by the difficulties faced when densifying sinterhardened parts. Thus, although the sinterhardening process provides distinct advantages, it is not widely used to produce powder metal parts for the heaviest duty races, gears, sprockets, and cam lobes, applications requiring high rolling contact endurance limits and/or high tensile strength.

Accordingly, a need exists for a process for producing parts from consolidated metallurgical powder wherein the parts are of high density and surface hardness greater than about RC 25, without the need for a conventional liquid quench-and-temper treatment. A need also exists for a process for producing powder metal parts having high rolling contact endurance limits and/or high tensile strength, and wherein the parts are surface hardened to greater than RC 25 without the need for a conventional liquid quench-and-temper treatment.

BRIEF SUMMARY OF THE INVENTION

In order to address the above-described needs, the present invention provides a novel method for producing a material from a metallurgical powder. The method includes providing a metallurgical powder that includes iron, 1.0 to 3.5 weight percent copper, and 0.3 to 0.8 weight percent carbon. The carbon in the metallurgical powder preferably is wholly or predominantly in the form of graphite. The copper in the metallurgical powder preferably is wholly or predominantly in the form of elemental copper powder. The metallurgical powder also may include, for example, nickel, molybdenum, chromium, manganese, and vanadium. The metallurgical powder preferably includes molybdenum and/or nickel in the form of a pre-alloyed iron-base powder.

At least a portion of the metallurgical powder is compressed at a pressure of 20 tsi to 70 tsi to provide a compact. The compact is heated to a temperature of 2000–2400° F. and is maintained at the temperature for at least 15 minutes. The heated compact is then cooled at a cooling rate no greater than 60° F./minute. The rate of cooling is selected so that the compact, once cooled, has hardness no greater than RC 25, and preferably no greater than RC 20. Subsequent to cooling the compact, the density of at least a surface region of the compact is increased to at least 7.6 grams/cc. The density of the compact may be increased by, for example, mechanically working the sintered compact. The mechanical working technique that is used may be one or more of, for example, sizing, rolling, roller burnishing, shot peening, extruding, laser impacting, swaging, and hot forming. The densification technique may be applied to increase the density of a surface region or some other region of the compact, but also may be applied to increase the density throughout the compact. The densified compact is then heated to a temperature of 2050–2400° F. and held at temperature for at least 20 minutes. The heated compact is cooled at a cooling rate greater than the rate of the first cooling step and within the range of 120–400° F./minute so as to increase surface hardness of the compact to greater than RC 25, and preferably at least as great as RC 30.

The present invention also is directed to a method for producing a material from a metallurgical powder, as the powder is described immediately above, and wherein at least a portion of the powder is compressed at a pressure of 20 tsi to 70 tsi to provide a compact. The compact is processed by heating and then cooling the compact. The apparent density of the cooled sintered compact is 6.2 to 7.2 grams/cc. The cooling rate is no greater than about 60° F. per minute so that the surface hardness of the cooled sintered compact increases to no greater than RC 25. The density of at least a portion of the sintered compact is then increased to at least 7.6 grams/cc, and the densified compact is then heated to provide a heated sintered compact. The heated sintered compact is cooled at a rate sufficient to increase the surface hardness of the compact to greater than RC 25, and preferably at least RC 30.

As noted above, carbon may be wholly or partially present in the metallurgical powder as graphite in either of the above methods. Carbon may also be present in the metallurgical powder in other forms, such as in the form of carbon alloyed with other elements as pre-alloyed powders. The carbon content, copper content, and the content of the other elements present in the metallurgical powder are selected so that on heating and then slowly cooling a compact of the powder, the hardness of the compact does not exceed RC 25.

Additional aspects of the present invention are directed to materials produced by the method of the invention and articles of manufacture including such materials. The articles of manufacture may be, for example, races, gears, sprockets, and cam lobes.

The surface hardness of materials provided in the present description are referred to by several different hardness scales, including RC, Rockwell B (RB), and 15N hardness. Each hardness scale used herein is the resistance to indentation as measured by a Rockwell hardness tester or a microhardness tester. Both tester types operate by forcing an indenter of a specified geometry and material into the surface of a test specimen under a controlled force, and the depth of penetration is measured. The hardness scale used to measure a particular part normally is tied to the application of that part. Those of ordinary skill in the art may readily convert an apparent hardness of one hardness scale (for example, RC, RB, or 15N) to another scale. The specific techniques by which hardness may be evaluated under any of the scales used herein also will be readily apparent to those of ordinary skill.

Material may be produced by the process of the invention with high surface hardness, greater than RC 25. The material also may have a relatively high endurance limit, at least about 240 ksi, and high torque and/or tensile strength. In the initial steps of the method of the invention, a readily deformable compact is produced that may be further densified. The compact is then densified in part or throughout to provide one or more highly dense regions, thereby providing high rolling contact endurance limit. Thus, the difficulties encountered in attempting to densify sinterhardened materials, which typically have surface hardness in excess of RC 25, are avoided. A sinter followed by an accelerated cooling step, which preferably is a gas cooling step, increases the surface hardness of the material to greater than RC 25, preferably at least RC 30, hardness levels commensurate with or superior to conventional sinterhardened materials. Utilizing gas cooling in the accelerated cooling step avoids the dimensional control difficulties encountered with conventional liquid quench-and-temper treatments. In addition, gas cooling does not require a liquid quenching media that must be disposed of as waste. Thus, the method of the invention provides a material with properties superior to conventional sinterhardened materials, yet also providing processing advantages garnered by the sinterhardening process.

The reader will appreciate the foregoing details and advantages of the present invention, as well as others, upon consideration of the following detailed description of embodiments of the invention. The reader also may comprehend additional advantages and details of the present invention upon carrying out or using the invention.

BRIEF DESCRIPTION OF THE DRAWINGS

The features and advantages of the present invention may be better understood by reference to the accompanying drawings in which.

DETAILED DESCRIPTION OF EMBODIMENTS OF THE INVENTION

Figure 1:
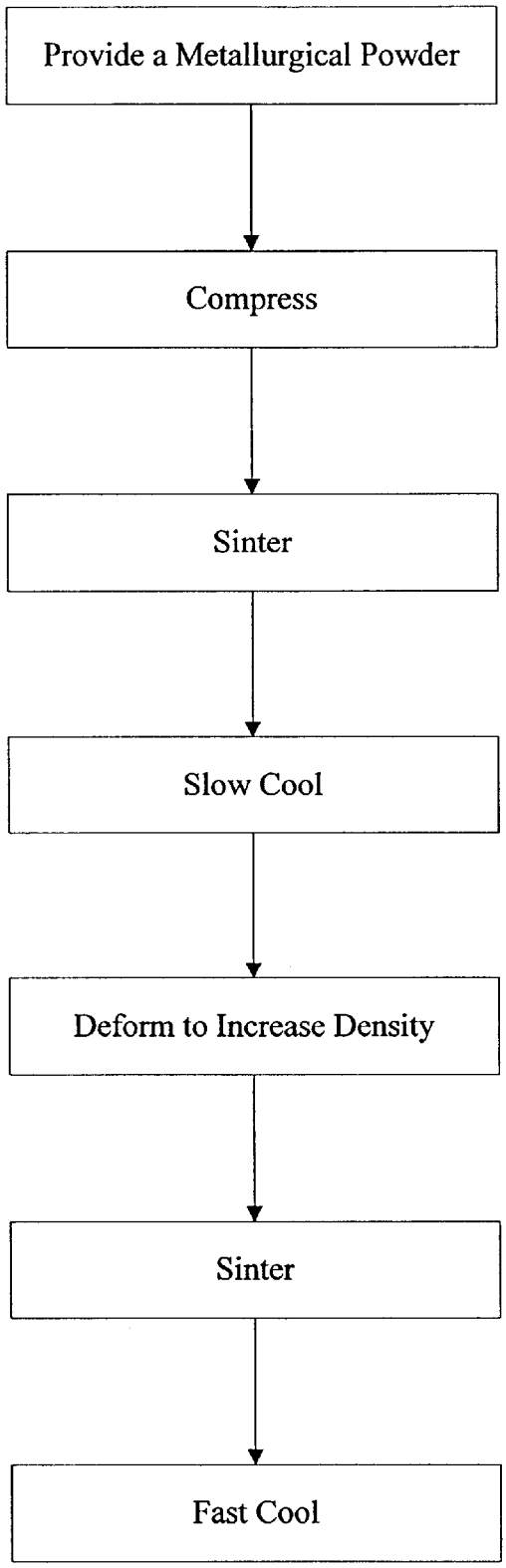
FIG. 1 is a block diagram of an embodiment of a method according to the present invention for producing powder metal material.

The present invention provides a novel method for producing relatively dense powder metal parts having surface hardness greater than RC 25. In general, the method includes consolidating a portion of a metallurgical powder including iron, 1.0 to 3.5 weight percent copper, and 0.3 to 0.8 weight percent carbon, preferably 0.4 to 0.7 weight percent carbon, to provide a green compact. Preferably, the carbon is present in the metallurgical powder wholly or predominantly as graphite. The copper in the metallurgical powder preferably is wholly or predominantly in the form of elemental copper powder. The metallurgical powder also may include, for example, one or more of nickel, molybdenum, chromium, manganese, and vanadium. The metallurgical powder preferably includes molybdenum and/or nickel in pre-alloy form with iron as an iron alloy powder. The constituents of the metallurgical powder are chosen so that a consolidated sintered material produced from the powder may be hardened by accelerated cooling, i.e., cooling at greater than 120° F./minute.

The green compact is initially sintered at high temperature to further fuse the powder particles and to diffuse the powder's chemical constituents within the compact. The sintered compact is then cooled at a low to moderate cooling rate, no greater than 60° F./minute, to provide a sintered compact having a typical density but much lower hardness than is characteristic of a sinterhardened part. The sintered compact is subsequently deformed by, for example, mechanical working, to increase the density of at least a surface region of the compact to a desired level, typically above 7.6 grams/cc. The worked compact is then heated to high temperature and cooled at a high cooling rate, 120 to 400° F./minute, to harden the surface of the compact to greater than RC 25, and preferably at least RC 30.

As shown below, material produced by the method of the invention may exhibit high rolling contact endurance limits, greater than the 170–190 ksi upper limit typically exhibited by material produced by conventional sinterhardening. Material produced by the method of the invention also may exhibit tensile strengths greater than tensile strengths of conventionally quench-and-tempered steels produced of metallurgical powders.

An embodiment of the method of the invention is depicted schematically in FIG. 1. In a first step of the embodiment, a suitable metallurgical powder is provided. The alloying element content and the carbon level of the powder are selected so that the powder may be pressed and sintered to form an iron-based material that can be readily deformed in the deformation step described below. Also, to ensure that the powder will form a material of sufficient density, it is preferred that the powder is capable of forming a material with an apparent density of at least about 6.8 grams/cc when pressed at 40 tsi. The powder may include, for example, iron, about 1.0 to about 3.5 weight percent copper, and about 0.3 to about 0.8 weight percent carbon. Preferably, the powder includes 0.4 to 0.7 weight percent carbon. Carbon in the form of graphite is preferred in the metallurgical powder, but other suitable carbon sources may be used. Preferably, copper is provided in the metallurgical powder wholly or at least predominantly as elemental copper powder. The powder may also include other alloying additions including, for example: up to about 2.0 weight percent molybdenum; up to about 0.7 weight percent manganese; up to about 4.0 weight percent chromium; up to about 2.0 weight percent nickel; and vanadium. The alloy additions may be added in the form of, for example, one or more pre-alloyed iron-base powders. The metallurgical powder preferably includes molybdenum and/or nickel as a pre-alloyed iron-base powder. Thus, the metallurgical powder may include iron and alloying additions in the form of one or more pre-alloyed powders, such as a nickel-molybdenum steel or a molybdenum steel powder. A mix of elemental powders or a mix of pre-alloyed and elemental powders also may be used. Other possible powder additions include, for example, metal carbides, metal nitrides, and high-speed steel powders, which may be added to improve wear resistance, conductivity, or other properties. Other possible powder additions will be apparent to those of ordinary skill on reviewing the present description of the invention.

The powder additions may include powders having carbon in alloyed or other form. Thus, it will be understood that the metallurgical powder includes carbon and may include it in the form of graphite, in alloyed form, and/or in any other suitable form. Typically, a suitable lubricant also is included in the metallurgical powder to facilitate compaction. Examples of suitable lubricants include stearic acid, zinc stearate, and ethylene bis-stearamide wax. One commercial form of EBS lubricant is Atomized Acrawax, available from Lonza.

Conventional sinterhard powder grades also may be used as the metallurgical powder in the method of the present invention. Such powder grades include, for example, Hoeganaes 85HP (0.85Mo—bal Fe, all in weight percentages), Hoeganaes 4600V (1.8Ni-0.6Mo-0.2Mn—bal Fe), and Hoeganaes 2000 (0.6Ni-0.6Mo-0.2Mn—bal Fe) powders, and QMP (Quebec Metal Powders) 4601 (1.8Ni-0.6Mo-0.2Mn—bal Fe), 4401 (0.85Mo—bal Fe), and 4201 (0.6Ni-0.6Mo-0.2Mn—bal Fe) powders. Less desirable sinterhard powder grades include Hoeganaes 737 (1.4Ni-1.25Mo-0.4Mn—bal Fe) and QMP 4701 (0.9Ni-1.0Mo-0.45Mn-0.5Cr—bal Fe) powders.

In the conventional sinterhardening process, heat treated properties are achieved in the sintering furnace by cooling the sintered compact at a cooling rate fast enough to convert a substantial portion of the microstructure to a strong, hard, martensitic structure. Whether martensite forms when the sintered compact is cooled from a temperature above the austenite temperature (about 1350–1450° F.) to room temperature depends principally on the alloy composition and the cooling rate. In the present method, the metallurgical powder composition is selected so that a consolidated compact of the powder does not harden significantly during the slow cooling step of the method, but will attain surface hardness above RC 25, and preferably above RC 30, during the subsequent, fast cooling step. Such powder compositions preferably are of pre-alloy powder. The inventor has determined that pure iron-based mixes do not harden as readily under typical accelerated gas cooling in a powder metal sintering furnace unless relatively large amounts of costly elemental additions are made to the powder. Even then, the transformation to martensite is not as uniform as when the elements are present in the powder in pre-alloyed form. The inventor also has determined that a higher carbon content in the powder results in more ready transformation to martensite during the accelerated cooling step of the method. Generally, if the carbon content of the powder blend is less than about 0.3 weight percent, it will be difficult to increase surface hardness above RC 25 on accelerated cooling. If the carbon content is greater than about 0.7 weight percent, the compact may harden to a level that is too high during the slow cooling step to allow subsequent densification. The preferred 0.3 to 0.7 weight percent carbon content assumes the use of a pre-alloyed base powder and the use of copper in the powder.

The addition of copper to the powder mix promotes increased hardness during the accelerated cooling step. If the copper content of the powder mix is less than about 1.0 weight percent, it may be difficult to sufficiently increase hardness of low alloy steel powders on accelerated cooling. Copper contents greater than about 3 weight percent appear to show little benefit in terms of increasing hardness.

One particular pre-alloyed powder that provides a workable compact on slow cooling and a sufficiently hard compact on fast cooling is a powder of 0.85 weight percent molybdenum and balance iron, such as, for example, Hoeganaes 85HP or QMP 4401 powders. Such powders transition to martensite during accelerated cooling at a rate that is slow relative to, for example, iron-based powders including 0.55 weight percent nickel and 0.6 weight percent molybdenum (for example, Hoeganaes 2000 or QMP 4201) or iron-based powders including 1.8 weight percent nickel and 0.6 weight percent molybdenum (for example, Hoeganaes 4600V or QMP 4601). Because, in general, higher copper and/or carbon additions more readily meet the desired hardness levels on both slow and fast cooling, the capability of conventional powders to meet those goals may be enhanced by additions of copper and/or carbon. For example, the following copper and/or carbon additions may be made to the conventional powders shown below:

| Base Powder | Copper Addition (weight %) | Carbon Addition (weight %) |
|---|---|---|
| 0.85 Mo steel powder | 1.8–2.6 | 0.45–0.75 |
| 0.55 Ni—0.6 Mo-Balance Fe powder | 1.6–2.4 | 0.4–0.70 |
| 1.8 Ni—0.6 Mo-Balance Fe powder | 1.5–2.2 | 0.4–0.65 |

The several powder compositions described above are provided by way of example only. One of ordinary skill, on reading the present description of the invention, may readily identify other powder compositions comprising iron, 1.0 to 3.5 weight percent copper, and 0.3 to 0.8 weight percent carbon that will provide a material having the desired hardness values on slow cooling and on fast cooling desired in the present method. Thus, the above examples should not be considered to limit the scope of the present invention.

In a second step of the embodiment of the present method, a portion of the metallurgical powder is compressed within a mold at a pressure in the range of about 20 tsi to about 70 tsi, and preferably about 30 tsi to about 60 tsi, and even more preferably about 35 tsi to about 50 tsi to lengthen tool life. The powder may be compressed to a green compact that is the same as or approximates the shape of the desired finished part.

In a third step, the green compact is sintered at a suitable high temperature. Preferably, the compact is sintered at a temperature within the range of about 2000° F. to about 2400° F., and more preferably about 2050° F. to about 2300° F. The compact is preferably held at the sintering temperature for at least 20 minutes. Typically, a heating time at sintering temperature may be 25–30 minutes. Total heating times may be, for example, about 15 to about 120 minutes, including the time necessary to heat the compact to sintering temperature. Holding the compact at the sintering temperature for a sufficient time period is important to ensure that the individual powders, principally the copper and carbon, diffuse throughout the compact, forming a generally homogenous iron-based alloy. Such concern may be less important when pre-alloyed powders are used. Preferably, the sintered alloy will exhibit hardness in the range of RB 50 to RB 100 and a well developed microstructure.

In a fourth step of the embodiment, the sintered compact is cooled at a cooling rate that does not harden the compact to the extent that it cannot be mechanically deformed in a succeeding step of the method. Preferably, the cooling rate is no greater than about 60° F./minute and, more preferably, no greater than about 20° F./minute. The cooling of the material may be accomplished by any suitable technique, as long as the hardness of the cooled compact is not excessive. Generally, lower cooling rates will lower hardness, but will also increase finished part cost. The hardness of the sintered compact after cooling should be less than RC 25, preferably less than RB 100, and more preferably less than RB 80, to ensure that the preform may be sufficiently mechanically worked. The sintered part preferably displays a density in the range of about 6.2 to about 7.2 grams/cc.

In a fifth step, the sintered compact is deformed so as to increase the density of at least a region of the compact. Density may be increased throughout the compact, or the density of only a surface region or other region of the compact may be increased, as desired based on the final application of the part. Preferably, the entire compact or the portion of the compact of interest is densified to at least 7.6 grams/cc, and more preferably is densified to a density in the range of 7.6 to about 7.85 grams/cc. Even more preferably, the upper limit of the density range is 7.8 grams/cc. Providing the desired region of the compact with a density of at least 7.6 grams/cc will bring properties such as tensile strength and fatigue properties to desirable levels. When the intended application of the powder metal part requires that the entire part surface or only a portion of the surface of the part has high rolling contact fatigue resistance, one need only increase the density of a region of the compact extending into the compact from its surface. In that case, the density of the interior portion of the compact would not be affected. In a part on which the surface has been densified in the present step to 7.6 to 7.8 grams/cc, the part may behave in rolling contact fatigue testing as if the entire bulk part had the increased density, even though the overall density of the part is increased only slightly. Powder metal parts that must have a dense and fatigue-resistant surface but need not have an overall density as great as the surface include, for example, bearing races and cam lobes for medium to heavy duty use.

The compact may be deformed to increase density using, for example, mechanical working techniques. Examples of such techniques include sizing, rolling, roller burnishing, shot peening or blasting, extruding, laser impacting, swaging, and hot forming. On considering the present description of the invention, one of ordinary skill may comprehend additional working techniques that may be used to densify all or a portion of the compact. The various working techniques may be carried out in a conventional manner. For that reason, a further discussion of the techniques need not be provided herein. If only the surface of the compact is densified (as in extruding, swaging, rolling, shot blasting, and laser impacting, for example), the overall density of the compact may only slightly increase, typically by 0.01 to 0.10 grams/cc. If the bulk part is densified (as in hot forming, for example), overall density may increase by 0.1 to 0.9 grams/cc or greater. Of the foregoing working techniques, rolling and roller burnishing are typically preferred because of low cost and simplicity of use. Rolling and roller burnishing are especially preferred for parts having rounded surfaces. Nevertheless, any mechanical working or other technique suitable to densify the parts may be used, and the method described herein is not limited to use of rolling, roller burnishing, or any other above-mentioned technique, even when applied to rounded parts.

In a sixth step of the present embodiment, the worked compact is heated at a sintering temperature in the range of 2050° F. to 2400° F. for overall times and times-at-temperature as described in connection with the initial sintering step. The hot compact, in a seventh step of the embodiment, is cooled at an accelerated cooling rate that is at least as great as about 120° F./minute, and is preferably in the range of 160–400° F./minute. The resintered compact is cooled at a rate necessary to increase its surface hardness to greater than RC 25, and preferably within the range of RC 30–50. The combined resinter and accelerated cool provides a part having a fine microstructure that is primarily martensitic and exhibits high hardness and tensile strength. The accelerated cooling of the material may occur in the chamber of a sintering furnace equipped to provide accelerated cooling by passing a cooling gas over the hot compact. Such accelerated cooling sintering furnaces include, for example, Drever Convecool and Abbot Furnaces VariCool sintering firnace models. Any other cooling technique may be employed that suitably provides a cooling rate of at least 120° F./minute. Although liquid quenching may be used, accelerated gas cooling usually is preferred to avoid the dimensional control problems associated with liquid quenching.

Parts produced using the above embodiment of the method of the present invention may be further processed to enhance their properties. For example, subsequent to cooling the resintered compact, the compact may be subjected to a heat treatment such as one or more of tempering, carburizing, nitriding, swaging, shot peening, nitriding, and induction heat treating. Thus, for example, a temper at 300° F. to 1350° F. or another single step or sequence of heat treatment steps may be used. A temper at 300° F. to 1350° F. typically may be carried out by heating a part at temperature for 0.5 to 2 hours. Air is a suitable tempering atmosphere up to 600–800° F. Above that range, a protective atmosphere, e.g., $N_2$, is preferred. Other steps that may be used subsequent to the step of cooling the heated sintered compact include any known powder metal fabrication technique that improves specific desired properties. Such properties include, for example, wear resistance and fatigue properties. Such fabrication techniques will be evident to those of ordinary skill and are not set forth herein. It also will be understood that suitable steps in addition to those set forth above may be utilized at any point in the method of the invention.

The method of the invention augments conventional sinterhardening processes by steps including an initial sinter followed by slow cooling to provide a sintered compact with a hardness that will allow ready deformation in the subsequent densification step. The densification step utilizes mechanical working or some other deformation technique to increase the density of all or a desired portion or region of the sintered compact. The result is a pressed and sintered compact of high density or, at least, including a highly dense region. A subsequent sinter followed by a relatively fast cool provides the compact with hardness greater than RC 25, and preferably at least RC 30. Thus, the finished parts have hardness characteristic of conventional sinterhardened materials, but with enhanced densities and, consequently, increased endurance limit, torque strength, and/or tensile strength. For example, the inventor has determined that the rolling contact endurance limit of material produced by the method of the invention typically is at least 240 ksi, and may be greater than 300 ksi. Such endurance values are much superior to the typical 150–200 ksi endurance limits of material produced by conventional sinterhardening techniques.

Specific examples of the method of the present invention follow.

EXAMPLE 1

A modified AISI type 4600 steel powder including 3.0 weight percent copper and 0.6 weight percent carbon was prepared by blending 97 parts (by weight) Kobelco 46F4 pre-alloyed steel powder (0.5Ni-1.0Mo-0.2Mn-0.1Cr—bal Fe, all in weight percentages), 3 parts Pyron 26006 copper powder, 0.6 parts Southwest Graphite 1652 powdered graphite (96 weight percent carbon, balance ash), and 0.65 parts Lonza Atomized Acrawax lubricant. A green compact was formed by molding a portion of the powder at 50 tsi. The density of the green compact was about 7.1 g/cc. The green compact was sintered at 2050° F. in a 95% $N_2$–5% $H_2$ (by volume) atmosphere and held at temperature for about 25 minutes. The heated compact was then cooled to room temperature within the sintering furnace at a cooling rate of about 40° F./min. The hardness of the cooled sintered compact was about RB 95. The cooled sintered compact was surface densified by roller burnishing using about 10,000 lb/inch of line contact. The compact was sintered in a fast cooling sintering furnace at 2300° F. in a 95% $N_2$–5% $H_2$ atmosphere for about 25 minutes at temperature, and then cooled to room temperature at a cooling rate of about 180° F./minute. The end product exhibited a hardness of RC 39 and an overall density of 7.05 grams/cc, although the density of the worked surface region was significantly greater, approximately 7.7 grams/cc. The rolling contact endurance limit of the material was 268 ksi, much higher than the expected value of 180 ksi for the same powder composition sinterhardened directly and without the low temperature sinter or the densification step.

EXAMPLE 2

Hot formed races were produced by the method of the invention as follows. A metallurgical powder blend (designated Mix 19139) was provided by blending 97.5 parts (by weight) Hoeganaes 0.85Mo—balance Fe steel powder, 2.5 parts Pyron 26006 copper powder, 0.68 parts Southwest Graphite 1652 graphite powder, and 0.75 parts Lonza Atomized Acrawax. The nominal sintered chemical composition of Mix 19139 was 0.85Mo-2.5Cu-0.6C—bal Fe. Parts formed from Mix 19139 by a method according to the present invention were compared with parts formed from a conventional powder mix (Mix FL4606) used to make races. Mix FL4606 was formed by blending 100 parts Hoeganaes 4600V steel powder, 0.6 parts Southwest Graphite 1652 graphite powder, and 0.75 parts Lonza Atomized Acrawax. The nominal sintered chemical composition of Mix FL4606 was 1.8Ni-0.55Mo-0.6C—bal Fe. Races were formed of the two mixes by placing a portion of each powder blend in a race die and compacting at 40 tsi to provide a compact having apparent density of about 6.9 grams/cc. The compacts were then sintered at 2050–2080° F. in a 95% $N_{2-5}$% $H_2$ atmosphere for about 30 minutes and cooled to room temperature at about 40° C./minute. The cooled compacts were dip coated with a graphite slurry to provide surface lubrication during hot forming and to prevent oxidation during transfer of the hot compact into the hot forming die. The slurry coated compacts were induction heated in an $N_2$ atmosphere to 1800° F. for about three minutes and placed into a hot forming die held at 600° F. The sintered compacts were struck at about 60 ksi to increase apparent density to 7.6–7.8 grams/cc, ejected from the die, and then slowly cooled in an $N_2$ atmosphere to room temperature. The cooled parts were grit blasted to remove any residual graphite from their surfaces.

Following grit blasting, three different processing cycles were used:

Cycle A—Process by a conventional sequence including carburizing the compact in a 0.8 volume percent carbon atmosphere for 4 hours at 1650° F., quenching, and tempering at 400° F. for one hour.

Cycle B—Resinter at 2300° F. in a 95% $N_2$–5% $H_2$ atmosphere for about 30 minutes in a Drever (Huntington Valley, Pa.) Convecool sintering furnace equipped with a fast cooling region providing cooling at 180° F./minute. Compacts were then tempered at 400° F. for one hour.

Cycle C—Process as in Cycle B except that the resinter was at 2100° F. followed by the fast cool at 150° F./minute.

After hot forming, and prior to performing any of the above cycles, compacts produced from Mix 19139 exhibited apparent density of about 7.6 grams/cc and 15N hardness of 84–86. The mechanical properties of parts produced from Mix 19139 and processed according to either Cycle B or Cycle C above were 221–263 ksi tensile strength, 188–220 ksi yield strength, and 1.7–2.3% elongation. The tensile strengths of the parts of Mix 19319 processed by Cycle B or Cycle C were superior to races formed of powder metal material and processed by conventional quench and temper treatment. Parts produced from the Mix 19139 powder and processed according to Cycle B or Cycle C also exhibited surface hardness comparable to races formed using conventional quench and temper processing techniques. The following table provides the density, torque strength, and hardnesses of races made from Mix 19139 and processed according to Cycle B or Cycle C and compares those properties with races made from Mix FL4606 processed according to the conventional carburization, quench, and temper sequence of Cycle A above.

| Process (Material) | Density (cc) | Surface Hardness (RC/15N) | Core Hardness (RC) | Torque Strength (Ft. lb.) |
|---|---|---|---|---|
| Cycle A (Mix FL4606) | 7.75 | 54/89 | 40 | 535 |
| Cycle B (Mix 19139) | 7.60 | 54/86 | 52 | 783 |
| Cycle C (Mix 19139) | 7.55 | 47/84 | 49 | 550 |

Although the average hardness of races made by methods according to the present invention (incorporating the steps of Cycle B or Cycle C) that are shown in the table are slightly lower than the races processed by conventional Cycle A, the hardness values are still well above the typical specification of 82 (15N) minimum for parts used in automotive race applications. The above data indicates that one may achieve a significant increase in the torque strength of a material by carefully controlling the resinter temperature and cooling rate at the expense of only a small reduction in hardness.

EXAMPLE 3

Parts produced by the method of the invention utilizing a hot forming step to enhance strength, elongation, and impact resistance were evaluated. A typical application for such high strength hot formed parts is as cam lobes for use in assembled cam shafts. Material for use in such applications conventionally has been produced by hot forming a compact of a 4600 steel and then tempering the material. Tensile strength specimen bars were made by conventional hot forming techniques from a powder mix having the following composition:

Mix FL4608—100 parts Hoeganaes 4600V steel powder, 0.85 parts Southwestern Graphite 1652 graphite powder, and 0.75 parts Lonza Atomized Acrawax.

The tensile bars were evaluated for mechanical properties and compared with material made by a method according to the present invention from the Mix 19139 powder described in Example 2 as follows. Compacts of all mixes were molded, sintered, cooled, hot formed, and grit cleaned as described in Example 2 above. Hot formed compacts produced from the FL4608 powder mix were then oil quenched and tempered in air at 400° C. Hot formed compacts produced from Mix 19139 powder were resintered at 2300° F. and cooled at 180° C./minute in a Drever Convecool sintering furnace. Mechanical properties for the final materials were as follows:

| Mix | Process | Density (g/cc) | Hard. (RC) | TS ksi | YS ksi | Elong. (%) | End. Lim. (ksi) | Charpy (ft. lb.) |
|---|---|---|---|---|---|---|---|---|
| FL4608 | HF + CQ & T400 | 7.75 | 50 | 214 | 214 | 1.0 | 340 | 19 |
| 19139 | HF + 2300° F. + Fast Cool | 7.65 | 48 | 260 | 180 | 2.2 | 320 | 40 |

Compared to the conventionally processed hot formed 4600-base material, the specimens produced from Mix 19139 by the method of the invention exhibited significantly higher tensile strength, elongation, and impact strength. Rolling contact fatigue properties (endurance limit) for all materials were comparable. The endurance limit of the Mix 19139 material greatly exceeded that of conventional sinterhardened material.

An aspect of the present invention is to combine the advantages of the sinterhardening process with the advantages of higher density. The mechanical properties of materials made by the method of the present invention are superior to the properties of conventional sinterhardened material. The enhancement in the mechanical properties is much greater than would be expected solely from the density increases achieved by the present invention.

Accordingly, the present invention addresses deficiencies of material produced by conventional sinterhardening techniques. The invention may substantially improve upon the rolling contact endurance limits exhibited by conventional sinterhardened powder metal materials. The invention also provides improvements in dimensional control relative to parts produced by conventional quench-and-temper processing because the present method may employ gas cooling, which is less severe on the parts than liquid quenching. Because no oils or other liquids are necessary for quenching, there are consequent cost and environmental benefits. Moreover, parts produced by the method of the present invention exhibit relatively high tensile strength, impact strength, and other mechanical properties.

It is to be understood that the present description illustrates aspects of the invention relevant to a clear understanding of the invention. Certain aspects of the invention that would be apparent to those of ordinary skill in the art and that, therefore, would not facilitate a better understanding of the invention have not been presented in order to simplify the present description. Although the present invention has been described in connection with certain embodiments, those of ordinary skill in the art will, upon considering the foregoing description, recognize that many modifications and variations of the invention may be employed. All such variations and modifications of the invention are intended to be covered by the foregoing description and the following claims.

I claim:

1. A method for producing a material from a metallurgical powder, the method comprising:

providing a metallurgical powder comprising iron, 1.0 to 3.5 weight percent copper, and 0.3 to 0.8 weight percent carbon, the weight percentages calculated based on the total weight of the powder;

compressing at least a portion of the metallurgical powder at a pressure of 20 tsi to 70 tsi to provide a compact;

heating the compact to a temperature of 2000° F. to 2400° F. and maintaining the compact at the temperature for at least 15 minutes to provide a sintered compact;

cooling the sintered compact at a cooling rate no greater than 60° F. per minute to provide the compact with hardness no greater than RC 25;

increasing the density of at least a surface region of the sintered compact to at least 7.6 grams/cc;

heating the sintered compact to a temperature of 2050° F. to 2400° F. and holding the sintered compact at the temperature for at least 20 minutes; and cooling the heated sintered compact at a cooling rate of 120° F./minute to 400° F./minute to increase hardness to greater than RC 25.

2. The method of claim 1, wherein cooling the heated sintered compact increases hardness to greater than RC 30.

3. The method of claim 1, wherein the metallurgical powder comprises 0.4 to 0.6 weight percent carbon.

4. The method of claim 1, wherein the carbon is present in the metallurgical powder at least predominantly as graphite.

5. The method of claim 1, wherein the copper is present in the metallurgical powder at least predominantly as elemental copper powder.

6. The method of claim 1, wherein the metallurgical powder further comprises at least one selected from the group comprising nickel, molybdenum, chromium, manganese, and vanadium.

7. The method of claim 1, wherein the metallurgical powder comprises an iron-base pre-alloyed powder including at least one of molybdenum and nickel.

8. The method of claim 1, wherein the metallurgical powder further comprises: 0 to 2.0 weight percent molybdenum; 0 to 3.0 weight percent nickel; 0 to 0.7 weight percent manganese; and 0 to 4.0 weight percent chromium.

9. The method of claim 1, wherein compressing the metallurgical powder provides a compact having apparent density of at least 6.8 grams/cc.

10. The method of claim 1, wherein compressing the metallurgical powder comprises compressing the metallurgical powder at a pressure of 30 tsi to 60 tsi.

11. The method of claim 1, wherein heating the compact comprises heating the compact to a temperature no greater than 2300° F.

12. The method of claim 1, wherein heating the compact comprises heating the compact to a temperature of 2000° F. to 2400° F. and maintaining the compact at the temperature for 25 to 35 minutes.

13. The method of claim 1, wherein heating the compact comprises heating the compact for a total time of 20 to 120 minutes.

14. The method of claim 1, wherein heating the compact provides a sintered compact having apparent density of at least 6.7 grams/cc.

15. The method of claim 14, wherein heating the compact provides a sintered compact having apparent density no greater than 7.2 grams/cc.

16. The method of claim 1, wherein cooling the sintered compact comprises cooling the sintered compact at a cooling rate at least as great as 50° F./minute.

17. The method of claim 1, wherein cooling the sintered compact comprises cooling the sintered compact at a cooling rate at least as great as 20° F./minute.

18. The method of claim 1, wherein cooling the sintered compact provides a cooled sintered compact having a hardness less than RB 100.

19. The method of claim 18, wherein cooling the sintered compact provides a cooled sintered compact having a hardness less than RB 90.

20. The method of claim 1, wherein cooling the sintered compact provides a cooled sintered compact having a hardness no greater than RC 20.

21. The method of claim 1, wherein heating the sintered compact and cooling the sintered compact occur in different zones of a single sintering furnace.

22. The method of claim 1, wherein increasing the density of at least a surface region of the sintered compact provides a sintered compact having at least a surface region with a density of 7.6 to 7.85 grams/cc.

23. The method of claim 1, wherein increasing the density of at least a surface region of the sintered compact comprises mechanically working the sintered compact.

24. The method of claim 19, wherein mechanically working the sintered compact comprises at least one of sizing, rolling, roller burnishing, shot peening, extruding, laser impacting, swaging, and hot forming the sintered compact.

25. The method of claim 24, wherein increasing the density of at least a surface region of the sintered compact comprises hot forming the sintered compact.

26. The method of claim 22, wherein hot forming the sintered compact comprises coating the sintered compact with lubricant, placing the sintered compact in a heated die, and applying pressure to the sintered compact.

27. The method of claim 24, wherein increasing the density of at least a surface region of the sintered compact comprises at least one of sizing, rolling, roller burnishing, extruding, shot peening, extruding, laser impacting, and swaging the sintered compact to increase the density of a surface region of the sintered compact to at least 7.6 grams/cc.

28. The method of claim 1, wherein heating the sintered compact comprises heating the sintered compact to a temperature of 2050° F. to 2400° F. and holding the sintered compact at the temperature for no greater than 40 minutes.

29. The method of claim 1, wherein heating the sintered compact comprises heating the sintered compact for a total time of no greater than 120 minutes.

30. The method of claim 1, wherein cooling the heated sintered compact provides a material having a hardness no greater than RC 50.

31. The method of claim 1, wherein both heating the sintered compact and cooling the heated sintered compact occur within different zones of a single sintering furnace.

32. The method of claim 1, wherein cooling the heated sintered compact comprises contacting the heated sintered compact with a cooling gas.

33. The method of claim 1, further comprising, subsequent to cooling the heated sintered compact, heat treating the sintered compact using at least one of tempering, carburizing, nitriding, swaging, shot peening and induction heat treating.

34. The method of claim 33, wherein heat treating the cooled, resintered compact comprises tempering the compact at 300 to 1350° F.

35. A method for producing a material from a metallurgical powder, the method comprising:

providing a metallurgical powder comprising iron, 1.0 to 3.5 weight percent copper, and 0.3 to 0.8 weight percent carbon, the weight percentages calculated based on the total weight of the powder;

compressing at least a portion of the metallurgical powder at a pressure of 20 tsi to 70 tsi to provide a compact;

heating the compact to provide a sintered compact having apparent density of 6.2 to 7.2 grams/cc;

cooling the sintered compact at a cooling rate no greater than 60° F. per minute to provide a sintered compact having a hardness no greater than RC 25;

increasing the density of at least a portion of the sintered compact so that at least a surface region of the sintered compact has a density of at least 7.6 grams/cc;

heating the sintered compact to provide a heated sintered compact; and cooling the heated sintered compact to increase the hardness of the compact to greater than RC 25.

36. The method of claim 35, wherein cooling the heated sintered compact to increase the hardness of the compact to at least RC 30.

37. The method of claim 36, wherein the metallurgical powder comprises 0.4 to 0.6 weight percent carbon.

38. The method of claim 35, wherein the carbon is present in the metallurgical powder as graphite.

39. The method of claim 35, wherein the copper is present in the metallurgical powder at least predominantly as elemental copper powder.

40. The method of claim 35, wherein the metallurgical powder further comprises at least one selected from the group comprising nickel, molybdenum, manganese, chromium, and vanadium.

41. The method of claim 32, wherein the metallurgical powder comprises an iron-base pre-alloyed powder including at least one of molybdenum and nickel.

42. The method of claim 35, wherein the metallurgical powder further comprises: 0 to 2.0 weight percent molybdenum; 0 to 3.0 weight percent nickel; 0 to 0.7 weight percent manganese; and 0 to 4.0 weight percent chromium.

43. The method of claim 35, wherein heating the compact comprises heating the green compact to a temperature of 2000° F. to 2400° F.

44. The method of claim 43, wherein heating the compact comprises heating the green compact to a temperature of 2000° F. to 2400° F. and holding the compact at the temperature for 25 to 35 minutes.

45. The method of claim 35, wherein heating the compact provides a sintered compact having apparent density no greater than 7.2 grams/cc.

46. The method of claim 35, wherein cooling the sintered compact provides a cooled sintered compact having a hardness less than RB 100.

47. The method of claim 46, wherein cooling the sintered compact provides a cooled sintered compact having a hardness less than RB 90.

48. The method of claim 35, wherein increasing the density of at least a portion of the sintered compact comprises mechanically working the sintered compact.

49. The method of claim 46, wherein mechanically working the sintered compact comprises at least one of sizing, rolling, roller burnishing, shot peening, extruding, laser impacting, swaging, and hot forming the sintered compact.

50. The method of claim 35, wherein heating the sintered compact comprises heating the sintered compact to a temperature of 2050° F. to 2400° F.

51. The method of claim 50, wherein heating the sintered compact comprises heating the sintered compact to a temperature of 2050° F. to 2400° F. and holding the sintered compact at the temperature for at least 20 minutes.

52. The method of claim 35, wherein cooling the heated sintered compact provides a material having a hardness of at least RC 50.

53. A material comprising iron, 1.0 to 3.5 weight percent copper, and 0.3 to 0.8 weight percent carbon, the weight percentages calculated based on the total weight of the material, and having a hardness of at least RC 30, the material produced by a method comprising:

providing a metallurgical powder;

compressing at least a portion of the metallurgical powder at a pressure of 20 tsi to 70 tsi to provide a compact;

heating the green compact to a temperature of 2000° F. to 2400° F. and maintaining the compact at the temperature for at least 15 minutes to provide a sintered compact;

cooling the sintered compact at a cooling rate no greater than 60° F. per minute to provide a compact having a hardness no greater than RC 25;

increasing the density of at least a portion of the sintered compact so that at least a surface region of the sintered compact has a density of at least 7.6 grams/cc;

heating the sintered compact to a temperature of 2050° F. to 2400° F. and holding the sintered compact at the temperature for at least 20 minutes to provide a heated sintered compact; and cooling the heated sintered compact at a cooling rate of 120° F./minute to 400° F./minute to increase the hardness of the compact to at least RC 30.

54. The material of claim 53, wherein the metallurgical powder comprises carbon at least predominantly in the form of graphite.

55. A material comprising iron, 1.0 to 3.5 weight percent copper, and 0.3 to 0.8 weight percent carbon, the weight percentages calculated based on the total weight of the material, and having a hardness of at least RC 30, the material produced by a method comprising:

providing a metallurgical powder;

compressing the powder at a pressure of 20 tsi to 70 tsi to provide a compact;

heating the compact to provide a sintered compact having a density of 6.2 to 7.2 grams/cc;

cooling the sintered compact at a cooling rate no greater than 60° F. per minute to provide a sintered compact having a hardness no greater than RC 25;

increasing the density of at least a portion of the sintered compact so that at least a surface region of the sintered compact has a density of at least 7.6 grams/cc;

heating the sintered compact to provide a heated resintered compact; and cooling the heated sintered compact to increase the hardness of the compact to greater than RC 25.

56. An article of manufacture comprising a material as recited in any of claims 53 and 55.

57. The article of claim 56, wherein the article is selected from a race, a gear, a sprocket, and a cam lobe.

* * * * *